US007956868B2

(12) United States Patent
Clock

(10) Patent No.: US 7,956,868 B2
(45) Date of Patent: Jun. 7, 2011

(54) GAMUT MAP MODEL WITH IMPROVED GRADATION FIDELITY AT LOW CHROMA VALUES

(75) Inventor: Jared Wayne Takeo Clock, Los Altos, CA (US)

(73) Assignee: Konica Minolta Systems Laboratory, Inc., San Mateo, CA (US)

( * ) Notice: Subject to any disclaimer, the term of this patent is extended or adjusted under 35 U.S.C. 154(b) by 877 days.

(21) Appl. No.: 11/862,128

(22) Filed: Sep. 26, 2007

(65) Prior Publication Data

US 2009/0079755 A1 Mar. 26, 2009

(51) Int. Cl.
*G09G 5/02* (2006.01)

(52) U.S. Cl. ..... 345/590; 345/589; 345/591; 345/600; 345/604; 382/167

(58) Field of Classification Search ..... None
See application file for complete search history.

(56) References Cited

U.S. PATENT DOCUMENTS

| | | | | |
|---|---|---|---|---|
| 6,388,674 | B1 * | 5/2002 | Ito et al. | 345/590 |
| 6,782,127 | B1 * | 8/2004 | Lee et al. | 382/166 |
| 7,623,266 | B2 * | 11/2009 | Sloan | 358/1.9 |
| 2008/0007806 | A1 * | 1/2008 | Shirasawa | 358/520 |

OTHER PUBLICATIONS

WCS Gamut Map Model Profile Schema and Algorithms, http://msdn2.microsoft.com/en-us/library/ms536899.aspx, 46 pages, printed from the Internet on Sep. 21, 2007.

* cited by examiner

*Primary Examiner* — Antonio A Caschera
(74) *Attorney, Agent, or Firm* — Chen Yoshimura LLP

(57) ABSTRACT

An improved gamut map model (GMM) useful in conjunction with Windows Color System (WCS). The method uses the WCS Minimum Color Difference (MinCD) GMM to handle gamut mapping for the Saturation rendering intent at low input chroma values. For input values to the gamut map model profile (GMMP), if the chroma value C falls within a predetermined chroma value range, the MinCD GMM will be applied, otherwise the Hue Mapping GMM is applied. The predetermined chroma value range can be determined by experimentation. The range is $0 \leqq C \leqq 10$ in a preferred embodiment. This method will improve the gradation fidelity of the rendered images and reduce or prevent major hue shifts at low chroma values. The method may be implemented as a plug-in utility for a computer.

4 Claims, 1 Drawing Sheet

GAMUT MAP MODEL WITH IMPROVED GRADATION FIDELITY AT LOW CHROMA VALUES

BACKGROUND OF THE INVENTION

1. Field of the Invention

This invention relates to color management implemented in computers, and in particular, it relates to gamut mapping models useful in conjunction with Windows Color System.

2. Description of Related Art

Windows Color System (WCS) is the color management scheme used by Microsoft's Windows Vista operating system. Minimum Color Difference (MinCD) and Hue Mapping are two gamut map models (GMMs) in WCS that correspond to different rendering intents established by the ICC (International Color Consortium) for color gamut mapping. In the MinCD GMM, which is equivalent to the ICC calorimetric intent, "In-gamut colors are left unchanged. For out-of-gamut colors, lightness and chroma are adjusted by finding the point in the destination gamut that has the minimum color distance from out-of-gamut input points." WCS Gamut Map Model Profile Schema and Algorithms, http://msdn2.microsoft.com/en-us/library/ms536899.aspx, pp. 6-7. The goal of MinCD is to provide the most "calorimetrically" correct output by minimizing the difference between the target and the destination colors. Colors that are inside both gamuts are not modified, colors from the target gamut that are not located within the destination gamut are moved to the closest boundary location on the output gamut. According to the above-cited document, "The MinCD GMM is suitable for mapping graphics and line art containing 'logo' colors (spot colors), logo color gradients with some out-of-gamut colors, and for the final stage of proofing transforms. While the MinCD GMM could be used for photographic images that are entirely within the destination gamut, it is not recommended for general rendering of photographic images. The mapping of out-of-gamut colors to colors on the destination gamut surface can result in unwanted artifacts, such as tone or chroma irregularities in smooth gradients that cross the gamut boundary." Id. at p. 6.

For WCS Hue Mapping, which is equivalent to the ICC Saturation rendering intent, the goal of the procedure is to maximize the chroma (or saturation) of the output image at the expense of the hue angle. The calorimetric accuracy of the output image color itself is not as important as the "vividness" of the output image. According to the above-cited document, Hue Mapping "first adjusts the hue of the input color value. Then it simultaneously adjusts the lightness and chroma, using a shearing mapping. Finally, it clips color value to make sure it is within gamut." Id. at pp. 17-22.

SUMMARY

The present invention is directed to an improved gamut map model that substantially obviates one or more of the problems due to limitations and disadvantages of the related art.

An object of the present invention is to improve the gradation fidelity of the rendered images and reduce or prevent major hue shifts at low chroma values.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and/or other objects, as embodied and broadly described, the present invention provides a method for rendering an image on a device, the image being defined by a plurality of points each having input color values, the method including: for each input point, calculating lightness, chroma, and hue values from the input color values; if the calculated chroma value falls within a predetermined range, using Minimum Color Difference as a gamut map model in a Gamut Map Model Profile to generate output color values; if the calculated chroma value falls outside of the predetermined range, using Hue Mapping as the gamut map model in the Gamut Map Model Profile to generate output color values; and rendering the image using the output color values.

In another aspect, the present invention provides a computer program product that causes a data processing apparatus to perform the above method.

It is to be understood that both the foregoing general description and the following detailed description are exemplary and explanatory and are intended to provide further explanation of the invention as claimed.

DETAILED DESCRIPTION OF PREFERRED EMBODIMENTS

Figure 1:
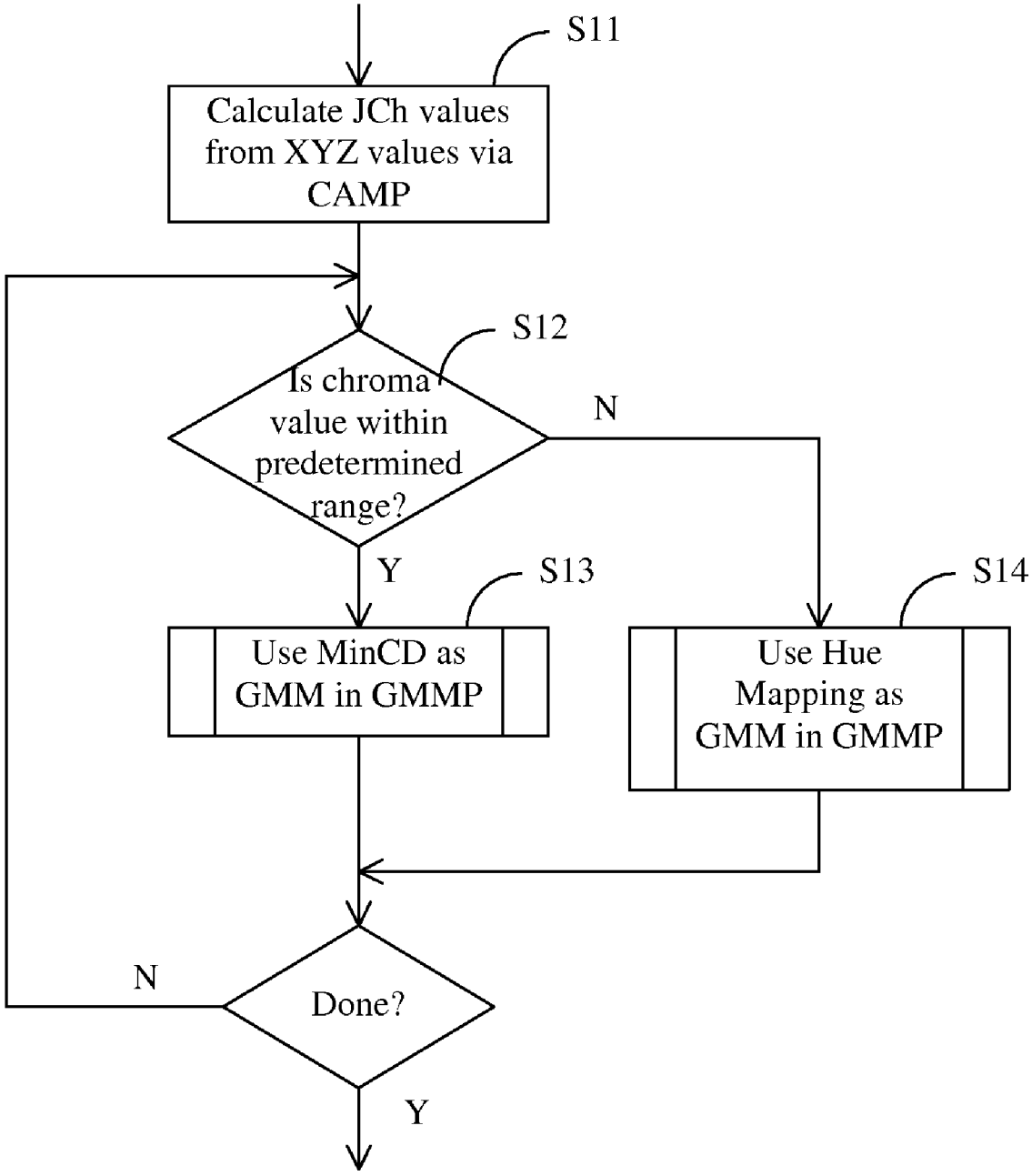
FIG. 1 is a flow chart illustrating a gamut map model according to an embodiment of the present invention.

For the Hue Mapping algorithm within Windows Color System (WCS), problems in gradation fidelity occur between major hue shifts (e.g., red to blue, magenta to green, etc.) at low chroma values. The chroma value range within which such problems occur is not a fixed value; rather, this range may depend on various factors, such as differing measured output data in the CDMP based on sampling parameters, or intrinsic characteristics of the selected output device itself. This chroma value range may be estimated based on experimentation. Analysis of sample images conducted by the inventor of the present invention showed that mapping problems tends to occur within the chroma (C) range of $0 \leqq C \leqq 10$.

According to an embodiment of the present invention, an improved gamut map model is provided, which uses the WCS Minimum Color Difference (MinCD) gamut map model (GMM) to handle gamut mapping for the Saturation rendering intent (RI) at low input chroma values. Specifically, for input values to the gamut map model profile (GMMP), if the chroma value C falls within a predetermined chroma value range, the MinCD GMM will be applied. If the C value is outside of the predetermined chroma value range, the Hue Mapping GMM is applied. The predetermined chroma value range is a range within which mapping problem tends to occur, and can be determined by experimentation as mentioned above. In a preferred embodiment, the predetermined chroma value range is $0 \leqq C \leqq 10$.

In the conventional method, for the Saturation rendering intent, Hue Mapping is used for all input L* and C values. In the improved gamut map model according to embodiments of the present invention, by applying the MinCD GMM at low chroma values, most input color values with low chroma values will be mapped to the same values in the output gamut. This is because almost all of the input points with low chroma values will be located in both the input and output device model gamuts, and for such input points the MinCD gamut mapping algorithm leaves the values unchanged, thereby avoiding hue shift. One exception may be input points representing essentially white colors, which tend to be located outside of the output gamut. These points will be mapped to the output gamut according to the MinCD algorithm. Since they are essentially white, no hue shift problem will occur. Further, since the input points with low chroma values contain little to no chromatic information, the loss of color saturation due to the use of MinCD at low chroma values will be minimal.

To implement the improved gamut map model, a plug-in software utility is provided on a computer. As shown in FIG. 1, for each input point in the image to be rendered (e.g. from an input image file to be rendered), the JCh color values (lightness (J), chroma (C), and hue (h)) are calculated from the XYZ color space values via CAMP (Color Appearance Model Profile of WCS) (step S11). The plug-in utility determines whether the chroma value (C) is within a predetermined range (e.g. $0 \leqq C \leqq 10$) (step S12). If it is, MinCD is used as the GMM in the GMMP (Gamut Map Model Profile) (step S13). If it is not, Hue Mapping is used as the GMM in the GMMP (step S14). Because the MinCD GMM is already utilized by WCS for certain other supporter RIs (relative colorimetric, absolute colorimetric, and Basic Photo), the plug-in utility simply switches the GMM from Hue Mapping to MinCD when the chroma value is within the predetermined range. The color values outputted by steps S13 or S14 are used to render the image on a device such as a display or a printer.

The improved gamut map model according to embodiments of the present invention is expected to improve the gradation fidelity of the rendered images and reduce or prevent major hue shifts at low chroma values.

It will be apparent to those skilled in the art that various modification and variations can be made in the improved gamut map model of the present invention without departing from the spirit or scope of the invention. Thus, it is intended that the present invention cover modifications and variations that come within the scope of the appended claims and their equivalents.

What is claimed is:

1. A method for rendering an image on a device, the image being defined by a plurality of input points each having input color values, the method comprising:

for each input point:

calculating a lightness value, a chroma value, and a hue value from the input color values;

if the calculated chroma value falls within a predetermined range, using Minimum Color Difference as a gamut map model in a Gamut Map Model Profile to generate output color values; and if the calculated chroma value falls outside of the predetermined range, using Hue Mapping as the gamut map model in the Gamut Map Model Profile to generate output color values; and rendering the image using the output color values.

2. The method of claim 1, wherein the predetermined range is from 0 to 10 inclusive.

3. A computer usable non-transitory medium having a computer readable program code embedded therein for controlling a data processing apparatus, the computer readable program code configured to cause the data processing apparatus to execute a process for mapping input color values to output color values, the process comprising:

for each input point:

calculating a lightness value, a chroma value, and a hue value from the input color values;

if the calculated chroma value falls within a predetermined range, using Minimum Color Difference as a gamut map model in a Gamut Map Model Profile to generate output color values; and if the calculated chroma value falls outside of the predetermined range, using Hue Mapping as the gamut map model in the Gamut Map Model Profile to generate output color values.

4. The computer usable non-transitory medium of claim 3, wherein the predetermined range is from 0 to 10 inclusive.

* * * * *